US007265067B1

(12) United States Patent
Phan

(10) Patent No.: US 7,265,067 B1
(45) Date of Patent: Sep. 4, 2007

(54) APPARATUS FOR MAKING STRUCTURED PAPER

(75) Inventor: Dean Van Phan, West Chester, OH (US)

(73) Assignee: The Procter & Gamble Company, Cincinnati, OH (US)

( * ) Notice: Subject to any disclaimer, the term of this patent is extended or adjusted under 35 U.S.C. 154(b) by 782 days.

(21) Appl. No.: 09/100,624

(22) Filed: Jun. 19, 1998

(51) Int. Cl.
*B32B 5/26* (2006.01)
*B32B 5/06* (2006.01)
*B32B 3/00* (2006.01)
*D21F 11/00* (2006.01)

(52) U.S. Cl. ..... 442/270; 442/203; 442/239; 442/240; 442/255; 442/277; 428/172; 428/196; 162/116; 162/362

(58) Field of Classification Search ..... 162/111, 162/109; 428/152, 153
See application file for complete search history.

(56) References Cited

U.S. PATENT DOCUMENTS

| | | | | |
|---|---|---|---|---|
| 3,301,746 | A | 1/1967 | Sanford et al. | 162/113 |
| 3,905,863 | A | 9/1975 | Ayers | 162/113 |
| 4,191,069 | A | 3/1980 | Sasso | 74/681 |
| 4,239,065 | A | 12/1980 | Trokhan | 139/383 A |
| 4,309,246 | A | 1/1982 | Hulit et al. | 162/113 |
| 4,421,600 | A | 12/1983 | Hostetler | 162/111 |
| 4,514,345 | A | 4/1985 | Johnson et al. | 264/22 |
| 4,528,239 | A | 7/1985 | Trokhan | 428/247 |
| 5,098,522 | A | 3/1992 | Smurkoski et al. | 162/358 |
| 5,260,171 | A | 11/1993 | Smurkoski et al. | 430/320 |
| 5,275,700 | A | 1/1994 | Trokhan | 162/358.1 |
| 5,328,565 | A | 7/1994 | Rasch | 162/113 |
| 5,334,289 | A | 8/1994 | Trokhan et al. | 162/358.2 |
| 5,429,686 | A | 7/1995 | Chiu et al. | 139/383 A |
| 5,431,786 | A | 7/1995 | Rasch et al. | 162/348 |
| 5,496,624 | A | 3/1996 | Stelljes, Jr. et al. | 428/229 |
| 5,500,277 | A | 3/1996 | Trokhan et al. | 428/196 |
| 5,514,523 | A | 5/1996 | Trokhan et al. | 430/320 |
| 5,554,467 | A | 9/1996 | Trokhan et al. | 430/11 |
| 5,556,509 | A | 9/1996 | Trokhan et al. | 162/111 |
| 5,566,724 | A | 10/1996 | Trokhan et al. | 139/383 A |
| 5,580,423 | A | 12/1996 | Ampulski et al. | 162/111.7 |
| 5,609,725 | A | 3/1997 | Phan | 162/117 |
| 5,624,790 | A | 4/1997 | Trokhan et al. | 430/320 |
| 5,628,876 | A | 5/1997 | Ayers et al. | 162/358.2 |
| 5,629,052 | A | 5/1997 | Trokhan et al. | 427/508 |
| 5,637,194 | A | 6/1997 | Ampulski et al. | 162/109 |
| 5,672,248 | A | 9/1997 | Wendt et al. | 162/109 |
| 5,674,663 | A | 10/1997 | McFarland et al. | 430/320 |
| 5,709,775 | A | 1/1998 | Trokhan et al. | 162/117 |

FOREIGN PATENT DOCUMENTS

| | | |
|---|---|---|
| FR | 394134 | * 10/1990 |
| WO | EP 0 526 592 | 4/1995 |
| WO | WO98/19008 | 5/1998 |

* cited by examiner

*Primary Examiner*—Jenna Befumo
(74) *Attorney, Agent, or Firm*—Peter D Meyer; David K. Mattheis; Larry H. Huston

(57) ABSTRACT

A papermaking belt for dewatering and imprinting a paper web. The belt comprises two laminae joined together in a face to face relationship to form a unitary laminate. The first lamina comprises a foraminous imprinting member which may serve as a reinforcing structure for a patterned framework. The second lamina comprises a secondary base and a batting which is joined to the secondary base to form a dewatering felt. The two lamina are juxtaposed and attached such that batting from the second lamina extends through the foraminous imprinting member of the first lamina providing a hydraulic connection therebetween.

21 Claims, 2 Drawing Sheets

APPARATUS FOR MAKING STRUCTURED PAPER

FIELD OF THE INVENTION

The present invention relates to papermaking, and more particularly to a papermaking belt comprising foraminous imprinting layer and a dewatering felt layer.

BACKGROUND OF THE INVENTION

Papermaking is a well known art. In papermaking cellulosic fibers and a liquid carrier are mixed together. The liquid carrier is drained away and the resulting embryonic web of cellulosic fibers is dried.

Drying is typically accomplished in one of two manners, through air drying or conventional drying. Through air drying relies upon blowing hot air through the embryonic web. Conventional drying relies upon a press felt to remove water from the web by capillary action.

Through air drying yields paper having regions of different densities. This type of paper has been used in commercially successful products, such as Bounty paper towels and Charmin and Charmin Ultra brands of bath tissues. However, there are or may be situations where one does not wish to utilize through air drying.

In these situations, conventional felt drying is used. However, conventional felt drying does not necessarily produce the structured paper and its attendant advantages. Accordingly, it has been desired to produce structured paper using conventional felt drying. This has been accomplished utilizing a conventional felt having a patterned framework thereon for imprinting the embryonic web. Examples of these attempts in the art include commonly assigned U.S. Pat. Nos. 5,556,509, issued Sep. 17, 1996 to Trokhan et al.; 5,580,423, issued Dec. 3, 1996 to Ampulski et al.; 5,609,725, issued Mar. 11, 1997 to Phan; 5,629,052, issued May 13, 1997 to Trokhan et al.; 5,637,194, issued Jun. 10, 1997 to Ampulski et al.; 5,674,663, issued Oct. 7, 1997 to McFarland et al.; and 5,709,775 issued Jan. 20, 1998 to Trokhan et al., the disclosures of which are incorporated herein by reference.

There are occasions where a conventional felt is used without a patterned framework thereon. In such cases, a paper web may be transported on a separate imprinting fabric and compressed in a compression nip formed between two rolls.

U.S. Pat. No. 4,421,600 issued Dec. 20, 1983 to Hostetler discloses an apparatus having two felts, three pressing operations, and a separate woven imprinting fabric. In Hostetler the web is transported on the imprinting fabric through the pressing operations before being delivered to the Yankee dryer.

Another such attempt in the art is illustrated by U.S. Pat. No. 4,309,246 issued Jan. 5, 1982 to Hulit et al. Hulit et al. describes three configurations where a nip is formed between two rolls. In each configuration, a paper web is carried on an imprinting fabric having compaction elements defined by knuckles formed at warp and weft crossover points. The imprinting fabric, web and a felt are compressed between the rolls. The web is carried from the nip on the imprinting fabric. In two embodiments, Hulit then transfers the web from the imprinting fabric to a Yankee drying drum. In the third embodiment, Hulit does not use a Yankee drying drum.

The Hulit arrangements have several disadvantages. First, two sets of nips are required, a first nip to imprint the web and a second nip where the web is transferred to the Yankee drying drum, Hulit recognizes that dryer drums may be utilized instead of, or in addition to, the Yankee drying drum. However, Hulit does not minimize the expense and inconvenience of requiring two separate nips for the configurations relying upon the Yankee drying drum—as most commonly occurs in the art.

Another attempt is shown in European Patent 0 526 592 B1 granted Apr. 5, 1995 to Erikson et al. Erikson et al. discloses another two nip configuration. In the first nip, the paper is imprinted between a press roll and a lower press roll. There, Erikson et al. dewaters the paper by placing the press felt directly against the paper. This allows the press felt to deform into the areas of the imprinting fabric not supported by knuckles, reducing the differential density effects of the compaction caused by the imprinting fabric.

Erikson imprints the paper and transfers it to the Yankee at a lower press roll. The paper is transferred to the Yankee drying drum at this point. However, the second press drum again imprints the paper. The problem presented by Erikson et al. is that at its second nip the imprinting belt is never in registration with the imprinted pattern provided at the first nip. Thus, Erikson unduly compacts the paper and destroys the caliper it creates by imprinting at the first nip.

Furthermore, Erikson et al. like the aforementioned attempts in the art, still requires a complex two nip system in order to bring the imprinting fabric/paper web combination into contact with a dewatering felt. Erikson requires the press felt loop to be outboard of the imprinting fabric loop. This arrangement creates a very expensive proposition for retrofit to existing machinery, as additional space, drives, etc. are required to add the separate felt loop. The cost of installing such a separate felt loop on an existing papermaking machine can be quite significant.

Commonly assigned U.S. Pat. No. 5,637,194 issued Jun. 10, 1997 to Ampulski et al., the disclosure of which is incorporated herein by reference, discloses an alternative paper machine embodiment where a first dewatering felt is positioned adjacent a face of the imprinting member as the molded web is carried on the imprinting member from a first compression nip formed between two pressure rolls and a second dewatering felt to a second compression nip formed between a pressure roll and a Yankee drying drum. The imprinting member imprints the molded web and carries it to the Yankee drying drum. The presence of the first felt adjacent the imprinting member at the two compression nips results in additional water removal from the web prior to transfer to the Yankee drum.

While Ampulski et al. represents a significant improvement over the prior art, Ampulski et al., still requires a complex two nip system in order to bring the imprinting fabric/paper web combination into contact with the dewatering felts. Ampulski requires the press felt loop to be outboard of the imprinting fabric loop. This arrangement creates a very expensive proposition for retrofit to existing machinery, as additional space, drives, etc. are required to add the separate felt loop. As mentioned previously, the cost of installing such an arrangement can be quite significant.

Accordingly, the present invention provides a web patterning apparatus suitable for making structured paper on a conventional papermaking machine. The invention further provides a web patterning apparatus capable of dewatering a paper web using conventional dewatering techniques such as a suction vacuum roll.

SUMMARY OF THE INVENTION

The invention comprises a papermaking belt. The belt comprises two lamina joined together in a face to face relationship to form a unitary laminate. The first lamina comprises a foraminous imprinting member having a paper web contacting surface and a second surface. The paper web contacting surface may include an optional patterned framework disposed thereon. The second lamina is a dewatering felt composed of non woven batting. The second lamina has a first felt surface and a second felt surface. The first felt surface of the second lamina is juxtaposed with and attached to the second surface of the first lamina. The second felt surface of the second lamina provides a machine contacting surface of the laminate.

Batting on the first felt surface of the second lamina extends through the foraminous imprinting member of the first lamina providing a hydraulic connection between the web contacting surface of the first lamina and the second lamina.

In one embodiment, the hydraulic connection is enhanced by needling the batting of the second lamina to the foraminous imprinting member of the first lamina.

In another embodiment, the foraminous imprinting member of the first lamina comprises two layers of interwoven yarns.

In another embodiment, the foraminous imprinting member of the first lamina comprises a jacquard weave or dobby weave.

BRIEF DESCRIPTION OF THE DRAWINGS

While the specification concludes with claims particularly pointing out and distinctly claiming the present invention, the invention will be better understood from the following description taken in conjunction with the accompanying drawings in which like designations are used to designate substantially identical elements, and in which:

DETAILED DESCRIPTION OF THE INVENTION

Figure 1:
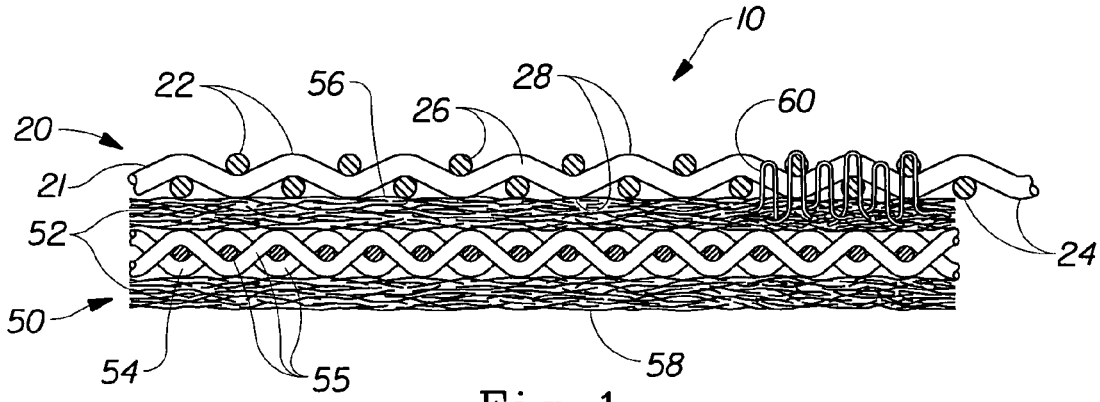
FIG. 1 is a cross sectional view of a laminated papermaking belt showing a first lamina comprising a foraminous imprinting member attached to a second lamina comprising a dewatering felt.
Figure 2:
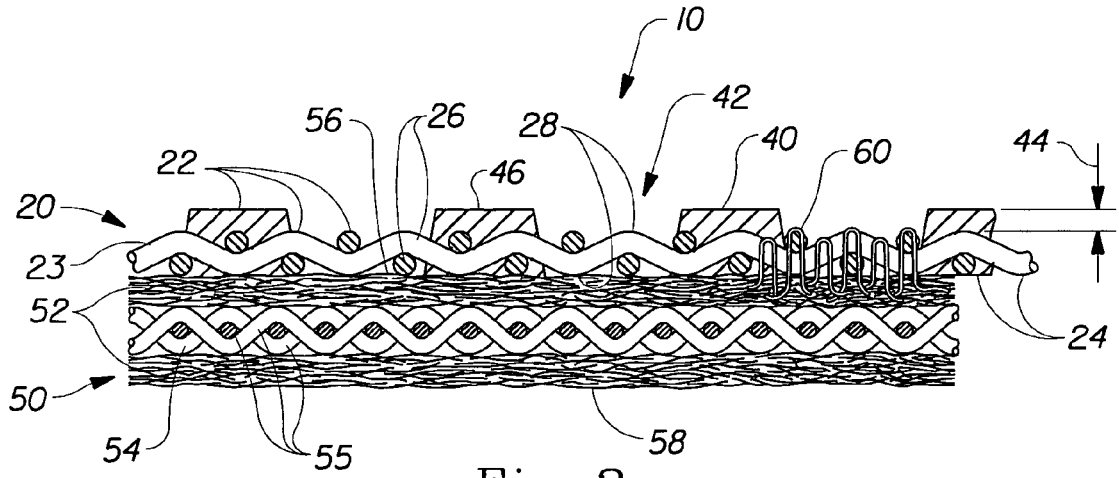
FIG. 2 is a view of the laminated papermaking belt of FIG. 1, wherein the foraminous imprinting member serves as a reinforcing structure for the belt and provides support for a patterned framework which is disposed thereon.

Referring to FIGS. 1 and 2, the belt 10 of the present invention is preferably an endless belt and carries a web of cellulosic fibers from a forming wire to a drying apparatus, typically a heated drum, such as a Yankee drying drum (not shown).

The belt 10 is a laminate comprising two lamina 20, 50. The first lamina 20 comprises a foraminous imprinting member 21 having a paper web contacting surface 22 and a second surface 24. The paper web contacting surface 22 may include an optional patterned framework 40 disposed thereon. The second lamina 50 is a dewatering felt composed of nonwoven batting 52. The second lamina 50 has a first felt surface 56 and a second felt surface 58. The second felt surface 58 of the second lamina 50 provides a machine contacting surface 59 of the laminate.

The first felt surface 56 of the second lamina 50 is juxtaposed with and attached to the second surface 24 of the first lamina 20. Batting 52 on the first felt surface 56 extends through the foraminous imprinting member 21 providing a hydraulic connection between the two laminae 20, 50. The two lamina 20, 50 may be attached by needling batting 60, comprising nonwoven batting 52 located near the first felt surface 56, between the first lamina 20 and the second lamina 50 to enhance the hydraulic connection therebetween.

The first lamina 20 is macroscopically monoplanar. The plane of the first lamina 20 defines its X-Y directions. Perpendicular to the X-Y directions and the plane of the first lamina 20 is the Z-direction of the first lamina 20. Likewise, the paper web according to the present invention can be thought of as macroscopically monoplanar and lying in an X-Y plane. Perpendicular to the X-Y directions and the plane of the web is the Z-direction of the paper web.

By "machine direction" it is meant the direction which is parallel to the principal flow of the paper web through the papermaking apparatus. By "cross machine direction" it is meant the direction which is perpendicular to the machine direction and lies within the plane of the belt.

The first lamina 20 includes a first surface 22 which contacts the paper web that is carried thereon and a second surface 24 which contacts the dewatering felt 50. The first lamina 20 comprises a woven fabric comparable to woven fabrics commonly used in the papermaking industry for imprinting belts. Such imprinting belts which are known to be suitable for this purpose are illustrated in commonly assigned U.S. Pat. Nos. 3,301,746 issued Jan. 31, 1967 to Sanford et al.; 3,905,863 issued Sep. 16, 1975 to Ayers; and 4,239,065 issued Dec. 16, 1982 to Trokhan, the disclosures of which are incorporated herein by reference.

Woven fabrics typically comprise warp and weft filaments 26 where warp filaments are parallel to the machine direction and weft filament are parallel to the cross machine direction. The warp and weft filaments 26 form discontinuous knuckles 28 where the filaments 26 cross over one another in succession. These discontinuous knuckles 28 provide discrete imprinted areas in the paper web during the papermaking process. As used herein the term "long knuckles" is used to define discontinuous knuckles formed as the warp and weft filaments 26 cross over two or more warp and weft filaments 26, respectively.

The filaments 26 of the woven fabric may be so woven and complimentarily serpentinely configured in at least the Z-direction of the lamina to provide a first grouping or array of coplanar top-surface-plane crossovers of both warp and weft filaments 26; and a predetermined second grouping or array of sub-top-surface crossovers. The arrays are interspersed so that portions of the top-surface-plane crossovers define an array of wicker-basket-like cavities in the top surface of the fabric. The cavities are disposed in staggered relation in both the machine direction and the cross machine direction such that each cavity spans at least one sub-top-surface crossover. A woven fabric having such arrays may be made according to commonly assigned U.S. Pat. Nos. 4,239,065, issued Dec. 16, 1980 to Trokhan; and 4,191,069, issued Mar. 4, 1980 to Trokhan, the disclosures of which are incorporated herein by reference.

For a woven fabric the term shed is used to define the number of warp filaments involved in a minimum repeating unit. The term "square weave" is defined as a weave of n-shed wherein each filament of one set of filaments (e.g., wefts or warps), alternately crosses over one and under n−1 filaments of the other set of filaments (e.g. wefts or warps) and each filament of the other set of filaments alternately passes under one and over n−1 filaments of the first set of filaments.

The woven fabric for the present invention is required to form and support the paper web and allow water to pass through. A preferred woven fabric for the first lamina comprises a "square weave" having a shed of 3 where each warp filament passes over two weft filaments and under one weft filament in succession and each weft filament passes over one warp filament and under two warp filaments in succession. A more preferred woven fabric for the first lamina is a "square weave" having a shed of 2 where each warp filament passes over one weft filament and under one weft filament in succession and each weft filament passes over one warp filament and under one warp filament in succession.

The caliper of the woven fabric may vary, however, in order to facilitate the hydraulic connection between the first and second lamina 20, 50 it is preferred that the caliper of the first lamina range from about 0.011 inch (0.279 mm) to about 0.026 inch (0.660 mm).

Air permeability is a measure of airflow through the woven fabric at a standard pressure drop across the fabric. The standard conditions are standard cubic feet per minute (scfm) at about 0.5 inch of water (cubic meters per second at about 12.7 mm of water). It is preferred that the woven fabric of the first lamina have an air permeability greater than 50 scfm (0.024 $m^3$/sec) and more preferably an air permeability greater than 300 scfm (0.142 $m^3$/sec) and most preferably an air permeability of about 300 scfm (0.024 $m^3$/sec) to about 1100 scfm (0.142 $m^3$/sec).

Figure 3:
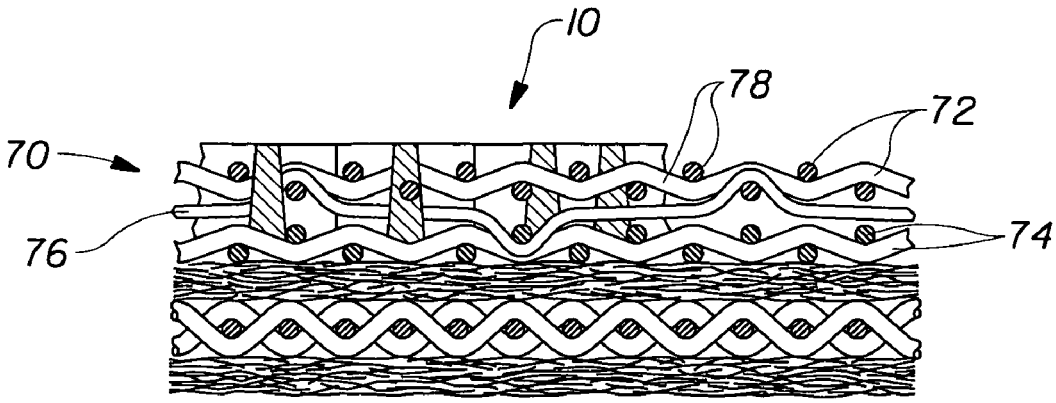
FIG. 3 is a view of the laminated papermaking belt of FIG. 1 wherein the foraminous imprinting member of the first lamina comprises a multi-layer fabric of at least two layers of interwoven yarns.

In an alternative embodiment of the present invention, as illustrated in FIG. 3, the first lamina 20 may comprise a multi-layer fabric having at least two layers of interwoven yarns 70, a paper web facing first layer 72 and a dewatering felt facing second layer 74 opposite the first layer 72. Each layer of the interwoven yarns is further comprised of interwoven warp and weft yarns 78. For this embodiment, the first lamina further comprises tie yarns 76 interwoven with the respective yarns of the paper web facing layer 72 and the dewatering felt facing layer 74. Illustrative belts having multiple layers of interwoven yarns are found in commonly assigned U.S. Pat. Nos. 5,496,624 issued Mar. 5, 1996 to Stelljes et al. 5,500,277 issued Mar. 19, 1996 to Trokhan et al. and 5,566,724 issued Oct. 22, 1996 to Trokhan et al. the disclosures of which are incorporated herein by reference.

As shown in FIG. 2, the foraminous imprinting member 21 of the first lamina 20 may serve as a reinforcing structure 23 for the belt 10 and provide support for a patterned framework 40 disposed thereon. Such framework 40 preferably comprises a cured polymeric photosensitive resin disposed on the paper web contacting surface 22 of the reinforcing structure 23.

Preferably the framework 40 defines a predetermined pattern which imprints a like pattern onto the paper which is carried thereon. A particularly preferred pattern for the framework 40 is an essentially continuous network. If the preferred essentially continuous network pattern is selected for the framework 40, discrete deflection conduits 42 will extend between the first surface 22 and the second surface 24 of the first lamina 20. The essentially continuous network surrounds and defines the deflection conduits 42.

The projected surface area of the continuous network top surface 46 can provide about 5 to about 75 percent of the projected area of the paper web contacting surface 22 of the first lamina 20 and is preferably about 25 percent to about 75 percent of the web contacting surface 22 and still more preferably about 65 percent of the web contacting surface 22.

The reinforcing structure 23 provides support for the patterned framework 40 and can comprise of various configurations, as previously described. Portions of the reinforcing structure 23 prevent fibers used in papermaking from passing completely through the deflection conduits 42 and thereby reduces the occurrences of pinholes. If one does not wish to use a woven fabric for the reinforcing structure 23, a nonwoven element, screen, net, or a plate having a plurality of holes therethrough may provide adequate strength and support for the framework 40 of the present invention.

The first lamina 20 having the patterned framework 40 disposed thereon according to the present invention may be made according to any of commonly assigned U.S. Pat. Nos. 4,514,345, issued Apr. 30, 1985 to Johnson et al.; 4,528,239, issued Jul. 9, 1985 to Trokhan; 5,098,522, issued Mar. 24, 1992; 5,260,171, issued Nov. 9, 1993 to Smurkoski et al.; 5,275,700, issued Jan. 4, 1994 to Trokhan; 5,328,565, issued Jul. 12, 1994 to Rasch et al.; 5,334,289, issued Aug. 2, 1994 to Trokhan et al.; 5,431,786, issued Jul. 11, 1995 to Rasch et al.; 5,496,624, issued Mar. 5, 1996 to Stelljes, Jr. et al.; 5,500,277, issued Mar. 19, 1996 to Trokhan et al.; 5,514,523, issued May 7, 1996 to Trokhan et al.; 5,554,467, issued Sep. 10, 1996, to Trokhan et al.; 5,566,724, issued Oct. 22, 1996 to Trokhan et al.; 5,624,790, issued Apr. 29, 1997 to Trokhan et al.; and 5,628,876, issued May 13, 1997 to Ayers et al., the disclosures of which are incorporated herein by reference.

Preferably, the framework 40 extends outwardly from the knuckles 28 of the reinforcing structure 23 a distance 44 less than about 0.15 millimeters (0.006 inch), more preferably less than about 0.10 millimeters (0.004 inch) and still more preferably less than about 0.05 millimeters (0.002 inch). Still more preferably the patterned framework 40 is approximately coincident the elevation of the knuckles 28 of the reinforcing structure 23. By having the patterned framework 40 extending outwardly such a short distance 44 from the reinforcing structure 23, a softer product may be produced. Specifically, the short distance provides for the absence of deflection or molding of the paper into the imprinting surface 22 of the first lamina 20 as occurs in the prior art. Thus, the resulting paper will have a smoother surface and less tactile roughness.

Furthermore, by having the framework 40 extend outwardly from the reinforcing structure 23 such a short distance 44, the reinforcing structure 23 will contact the paper at top surface knuckles 28 disposed within the deflection conduits 42. This arrangement further compacts the paper at the points coincident the knuckles 28 against the Yankee drying drum, decreasing the X-Y spacing between compacted regions.

Thus, more frequent and closely spaced contact between the paper and the Yankee occurs. One of the benefits of the present invention is that the imprinting of the paper and transfer to the Yankee occur simultaneously, eliminating the multi-operational steps involving separate compression nips of the prior art. Also, by transferring substantially full contact of the paper to the Yankee—rather than just the imprinted region as occurs in the prior art—full contact drying can be obtained.

Figure 4:
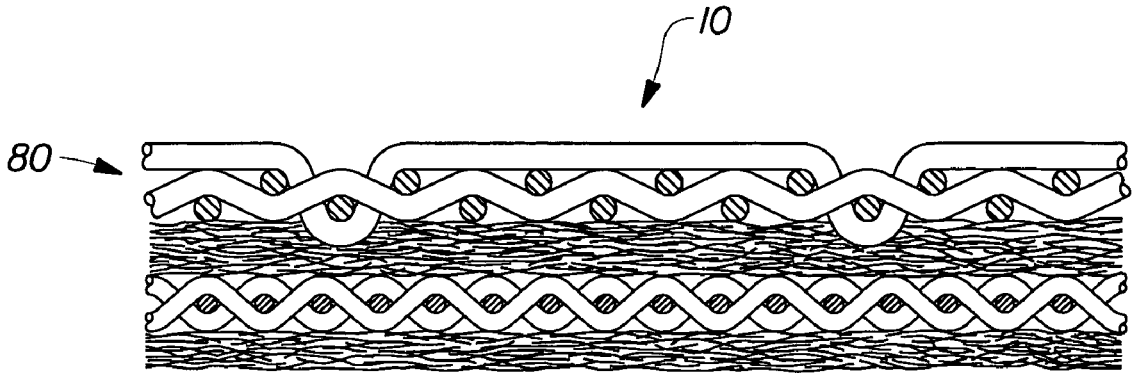
FIG. 4 is a view of the laminated papermaking belt of FIG. 1 wherein the foraminous imprinting member of the first lamina comprises a jacquard weave or dobby weave.

If desired, in place of the first lamina 20 having the patterned framework 40 described above, a belt having a jacquard weave or dobby weave 80 may be utilized as shown in FIG. 4. Such a belt may be utilized as an imprinting member 21 or reinforcing structure 23. The jacquard weave or dobby weave 80 is reported in the literature to be particularly useful where one does not wish to compress or imprint the paper in a nip, such as typically occurs upon transfer to a Yankee drying drum. Illustrative belts having a jacquard weave or dobby weave 80 are found in U.S. Pat. Nos. 5,429,686 issued Jul. 4, 1995 to Chiu et al. and 5,672,248 issued Sep. 30, 1997 to Wendt et al. the disclosures of which are incorporated herein by reference for the limited purpose of showing a jacquard weave.

The second lamina 50, like the first lamina 20, is macroscopically monoplanar. The plane of the second lamina 50 defines its X-Y directions. Perpendicular to the X-Y directions and the plane of the second lamina 50 is the Z-direction of the second lamina 50.

A suitable dewatering felt layer for the second lamina 50 comprises a nonwoven batt 52 of natural or synthetic fibers joined, such as by needling, to a secondary base 54 formed of woven filaments 55. The secondary base 54 serves as a support structure for the batt of fibers. Suitable materials from which the nonwoven batt can be formed include but are not limited to natural fibers such as wool and synthetic fibers such as polyester and nylon. The fibers from which the batt 52 is formed can have a denier of between about 3 and about 20 grams per 9000 meters of filament length.

The second lamina 50 has a surface batting with a denier of less than 5, and preferably less than 3. The surface batting on the first felt surface 56 extends through the foraminous first lamina 20 and contacts the paper web during papermaking. This contact enhances the water removal from the first lamina 20 and hence from the web.

The felt layer 50 can have a layered construction, and can comprise a mixture of fiber types and sizes. The layers of felt 50 are formed to promote transport of water received from the web contacting surface 22 of the first lamina 20 away from the first felt surface 56 and toward the second felt surface 58. The felt layer 50 can have finer, relatively densely packed fibers disposed adjacent the first felt surface 56. The felt layer 50 preferably has a relatively high density and relatively small pore size adjacent the first felt surface 56 as compared to the density and pore size of the felt layer adjacent the second felt surface 58, such that water entering the first surface 56 is drained away toward the second felt surface 58.

The dewatering felt layer 50 can have a thickness greater than about 2 mm (0.079 inch). In one embodiment the dewatering felt layer 50 can have a thickness of between about 2 mm (0.079 inch) and about 5 mm (0.197 inch). The dewatering felt layer 50 can have a compressibility of at least about 30 percent, and in one embodiment the felt layer 50 can have a compressibility of at least about 40 percent.

Compressibility is a measure of compactness of the dewatering felt under load. Compaction influences void volume and drainage of the felt. Compaction resistance is a desired property for dewatering felts compressed during the papermaking process. Thickness affects the compaction characteristics of the felt as well as felt wear.

The thickness and compressibility are measured with a constant rate of compression tester, such as an Instron Model 4502, available from Instron Engineering of Canton, Mass. The measurements are made between a smooth steel base plate (5.5 inches in diameter, Instron part number T504173) and a circular compression foot (0.987 inches in diameter) centered over the base plate and attached to a gimbaled mounting on a crosshead. The crosshead speed is about 0.5 inch per minute.

Prior to measuring the thickness and compressibility, the instrument is calibrated in the following manner to determine a correction factor as a function of loading pressure. The circular compression foot is moved toward the smooth base until the foot and the base just touch, and no light passes between them. This is considered the zero-load, zero-thickness point. The cross head is then moved back 0.500 inch (12.7 mm) to allow for insertion of the sample. (A gap larger than 0.500 inches (12.7 mm) can be used for thicker samples, provided the larger gap is precisely measured and used in place of 0.500 inches (12.7 mm) in determining the correction factors.) The instrument is then reset to zero displacement. A calibration compression is then done (without the sample in the instrument) at pressures between 0 and 1000 psi to provide a calibration crosshead displacement at the different pressures. When measuring the sample thickness at any pressure, the correction factor for that pressure is the calibration crosshead displacement at that pressure minus 0.500 inch (12.7 mm).

The sample is tested by placing it between the base plate and the compression crosshead and recording load versus crosshead displacement over a range of 0-1000 psi. The load is calculated as the force read from the instrument divided by the area of the compression foot. Thickness readings of the sample at 1 psi and 1000 psi are calculated by reading the crosshead displacement and applying the corresponding correction factor to obtain the corrected thicknesses at 1 psi and 1000 psi. The thickness of the felt layer 220 is the average of five corrected thickness measurements made at 1 psi. The compressibility of the felt layer 220 is 100 times the ratio obtained by dividing the corrected thickness of the felt layer at 1000 psi by the corrected thickness of the felt layer at 1 psi. The ratio is determined from an average of five measurements at 1 psi and five measurements at 1000 psi.

The dewatering felt layer 50 can have an air permeability of between about 5 and about 300 standard cubic feet per minute (scfm) (0.002 $m^3$/sec–0.142 $m^3$/sec) with an air permeability of less than 50 scfm (0.24 $m^3$/sec) being preferred for use with the present invention. Air permeability in scfm is a measure of the number of cubic feet of air per minute that pass through a one square foot area of a felt layer, at a pressure differential across the dewatering felt thickness of about 0.5 inch (12.7 mm) of water. The air permeability is measured using a Valmet permeability measuring device (Model Wigo Taifun Type 1000) available from the Valmet Corp. of Helsinki, Finland.

The dewatering felt layer 50 can have a water holding capacity of at least about 100 milligrams of water per square centimeter of surface area. The water holding capacity is a measure of the amount of water that can be contained in a one square centimeter section of the dewatering felt. In one embodiment, the dewatering felt layer 50 has a water holding capacity of at least about 150 mg/square cm.

The dewatering felt layer 50 can have a small pore capacity of at least about 10 mg/square cm. The small pore capacity is a measure of the amount of water that can be contained in relatively small capillary openings in a one square centimeter section of a dewatering felt. By relatively small capillary openings, it is meant capillary openings having an effective radius of about 75 micrometers or less. Such capillary openings are similar in size to those in a wet paper web. Accordingly, the small pore capacity provides an indication of the ability of the dewatering felt to compete for water from a wet paper web. In one embodiment, the dewatering felt 50 can have a small pore capacity of at least about 25 mg/square cm. Preferably, the felts will have an average pore volume distribution of less than 50 microns.

For effective water removal from the paper web, it is important that a hydraulic connection be made between the paper web, the first lamina 20, and the second lamina 50. As described above, the surface batting on the first felt surface 56 extends through the foraminous first lamina 20 and contacts the paper web during papermaking. The contact between the batting of the first felt surface 56 and the paper web provides the hydraulic connection between the web and the two lamina 20, 50.

The first and second laminae 20, 50 are preferably connected by needling batting 60 from the first felt surface 56 of the second lamina 50 through the foraminous imprinting member 21 or the reinforcing structure 23 of the first lamina 20. As the amount of needled batting 60 is increased, the hydraulic connection is enhanced.

For the embodiment shown in FIG. 2 having a patterned framework disposed on the reinforcing structure 23, it may be necessary to limit the amount of batting 60 needled between the first felt surface 56 and the reinforcing structure 23 since excessive needling may damage the patterned framework 40.

Prophetically, an alternative means of attaching the first and second lamina 20, 50 involves applying an adhesive to only the discontinuous knuckles 28 on the second surface 24 of the reinforcing structure 23 and pressing the two laminae 20, 50 together. Such adhesive must be applied in limited amounts in order to minimize the blockage of water flow through the first lamina. Alternatively or in addition to the adhesive bonding, the needling of batting 60 may be limited to areas along edges of the belt 10 in order to minimize damage to the patterned framework 40.

While particular embodiments of the present invention have been illustrated and described, it would be obvious to those skilled in the art that various other changes and modifications can be made without departing from the spirit and scope of the invention. It is intended to cover in the appended claims all such changes and modifications that are within the scope of the invention.

REFERENCE NUMERALS

10 Belt
20 First Lamina
21 Foraminous Imprinting Member
22 Web Contacting Surface
23 Reinforcing Structure
24 Second Surface Of First Lamina
26 Warp And Weft Yarns
28 Discontinuous Knuckles
40 Patterned Framework
42 Deflection Conduits
44 Distance Framework Extends From Reinforcing Structure
46 Continuous Network Top Surface
50 Second Lamina
52 Nonwoven Batt
54 Secondary Base
55 Woven Filaments
56 First Felt Surface
58 Second Felt Surface
59 Machine Contacting Surface
60 Second Batting
70 Two Layers Of Interwoven Yarn
72 Paper Web Facing First Layer
74 Dewatering Felt Facing Second Layer
76 Tie Yarn
80 Jacquard Weave/Dobby Weave

What is claimed is:

1. A papermaking belt comprising:
two laminae, a first lamina and a second lamina, said first and second laminae being joined in face-to-face relationship to form a unitary laminate;
said laminate having a first surface and a second surface opposed thereto,
said first surface being a paper web contacting surface and
said second surface being a machine contacting surface;
said first lamina comprising a woven fabric reinforcing structure and a patterned framework;
said patterned framework facing outwardly from said reinforcing structure whereby said patterned framework forms said first surface of said laminate;
said second lamina comprising a secondary base and batting joined thereto;
wherein said batting forms said second surface of said laminate,
wherein said batting extends through said reinforcing structure of said first lamina, and,
wherein an air permeability of the reinforcing structure of the first lamina is greater than an air permeability of the second lamina.

2. The papermaking belt of claim 1, wherein said patterned framework extends outwardly from said reinforcing structure from about 0.05 to about 0.25 mm.

3. The papermaking belt of claim 2, wherein said patterned framework comprises an essentially continuous network.

4. The papermaking belt of claim 3, wherein said essentially continuous network provides from about 25 percent to about 75 percent of the paper web contacting surface.

5. The papermaking belt of claim 1, wherein said batting has a basis weight of about 100 to about 1000 grams per square meter.

6. The papermaking belt of claim 1, wherein said first lamina and said second lamina are joined in face to face relationship by said batting.

7. The papermaking belt of claim 1, wherein said patterned framework comprises a photosensitive resin.

8. The papermaking belt of claim 1, wherein said reinforcing structure has a caliper of about 0.279 mm to about 0.660 mm.

9. The paper making belt of claim 1, wherein said reinforcing structure has an air permeability of about 300 scfm to about 1100 scfm.

10. The papermaking belt of claim 1, wherein said reinforcing structure comprises a square weave woven fabric having a shed of 2.

11. A papermaking belt comprising:
two laminae, a first lamina and a second lamina, said first and second laminae being joined in face-to-face relationship to form a laminate;
said laminate having a first surface and a second surface opposed thereto,
said first surface being a paper web contacting surface and said second surface being a machine contacting surface;

said first lamina comprising a first layer of woven warp and weft yarns;

said warp and weft yarns being woven to provide discrete imprinting knuckles;

said discrete imprinting knuckles forming said first surface of said laminate;

said second lamina comprising a secondary base and batting joined thereto;

wherein said batting forms said second surface of said laminate and extends into said first lamina.

12. The papermaking belt of claim 11, wherein said batting of said second lamina is needled between said first lamina and said second lamina.

13. The papermaking belt of claim 11, wherein said first lamina comprises a multi-layer fabric having a second layer of warp and weft yarns, said second layer being interposed between said first layer of said first lamina and said second lamina.

14. The papermaking belt of claim 13, wherein said long knuckles are oriented in a machine direction.

15. The papermaking belt of claim 11, wherein said first layer is woven to define bilaterally staggered sub-top surface-crossovers.

16. The papermaking belt of claim 11, wherein said warp and weft yarns are woven to provide long knuckles.

17. A papermaking belt comprising:

two laminae, a first lamina and a second lamina, said first and second laminae being joined in face-to-face relationship to form a laminate;

said laminate having a first surface and a second surface opposed thereto, said first surface being a paper web contacting surface, said second surface being a machine contacting surface;

said first lamina having a first layer and a second layer;

said first layer comprising woven warp and weft yarns providing discrete imprinting knuckles;

said second layer comprising a patterned framework disposed on said first layer and extending outwardly therefrom;

said patterned framework forming a first imprinting pattern on said first surface of said laminate, said first imprinting pattern being imprintable upon a paper web during papermaking;

said second lamina comprising a secondary base and batting joined thereto;

wherein said batting forms said second surface of said laminate and extends into said first lamina.

18. The papermaking belt of claim 17, wherein said patterned framework extends outwardly from said first layer from about 0.05 to about 0.25 mm.

19. The papermaking belt of claim 18, wherein said patterned framework comprises an essentially continuous network.

20. The papermaking belt of claim 17, wherein said batting of said second lamina is needled between said first lamina and said second lamina.

21. The papermaking belt of claim 17, wherein said discrete imprinting knuckles provide a second imprinting pattern within said patterned framework, said second imprinting pattern being imprintable upon a paper web during papermaking.

* * * * *